US007118491B2

(12) United States Patent
Mootoo

(10) Patent No.: US 7,118,491 B2
(45) Date of Patent: Oct. 10, 2006

(54) RADO'S CYLINDRICAL GOLF CLUB HEADS AND MULTIFACETED HAND GRIPS

(75) Inventor: Raphael Rado Mootoo, 3863 Pinewood Ter., Falls Church, VA (US) 22041

(73) Assignee: Raphael Rado Mootoo, Falls Church, VA (US)

( * ) Notice: Subject to any disclaimer, the term of this patent is extended or adjusted under 35 U.S.C. 154(b) by 163 days.

(21) Appl. No.: 10/902,152

(22) Filed: Jul. 30, 2004

(65) Prior Publication Data

US 2006/0025232 A1 Feb. 2, 2006

(51) Int. Cl.
*A63B 53/00* (2006.01)
*A63B 53/04* (2006.01)
*A63B 53/14* (2006.01)

(52) U.S. Cl. ..... 473/290; 473/330; 473/331; 473/238; 473/203

(58) Field of Classification Search ..... 473/330, 473/733–735, 412, 293, 313–314, 287–292, 473/331, 238, 201–204; D21/759
See application file for complete search history.

(56) References Cited

U.S. PATENT DOCUMENTS

D188,678 S * 8/1960 Holdstein ..... D21/728
4,116,440 A * 9/1978 Takeshima ..... 473/203
4,725,062 A * 2/1988 Kinney, III ..... 473/330
4,776,594 A * 10/1988 Rango ..... 473/249
4,872,684 A * 10/1989 Dippel ..... 473/253
4,902,016 A * 2/1990 Boone ..... 473/330
4,964,192 A * 10/1990 Marui ..... 16/421
5,224,702 A * 7/1993 Turner ..... 473/314
D353,176 S * 12/1994 Poggi ..... D21/733
D410,053 S * 5/1999 Wu ..... D21/733
D496,415 S * 9/2004 MacDonald ..... D21/733
2002/0132683 A1* 9/2002 Buchanan ..... 473/340

* cited by examiner

*Primary Examiner*—Sebastiano Passaniti

(57) ABSTRACT

A new Golf Club Head design, as compared to the previous art, Cylindrical in shape, with a larger more concentrated Circular face that has Circular Grooves, with a Convex back, with no Heel and Toe, has a sole plate that wraps around the convex back up to the half mark on both sides of the wooden golf club head, and a unique Neck, Hosel Tube Neck and Shaft 'placement' that abuts the approximate Center on the outside at right angles to the golf club head. And this new design incorporates a multifaceted hand grip for the club shaft. This Cylindrical shape head will permit the club head to be always soled and as such, the golf club will not fall backwards as the prior art does without the shaft being held firmly by the golfer. And, so, with this new multifaceted hand grip design, the golfer would not have to hold onto the club shaft any tighter in order to prevent the golf club from twisting, in his/her hands, at impact with the golf ball. The golf club head is to be of solid construction with a circular face ranging from approximately two and one-quarter (2¼) inches to two and one-half (2½) inches in diameter. The positioning of the neck, the hosel tube neck and the shaft will allow for a double driving action with the face pulling the back forward while at the same instant the back will be pushing the face forward.

7 Claims, 5 Drawing Sheets

FIG.8 (Prior Art)
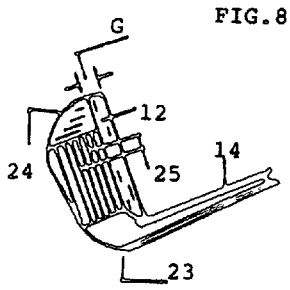
FIG.9
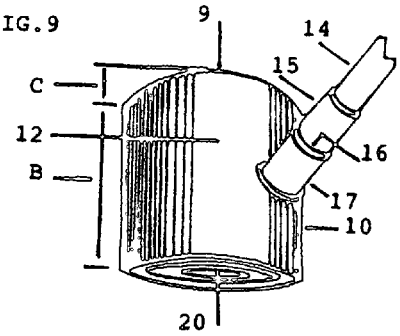
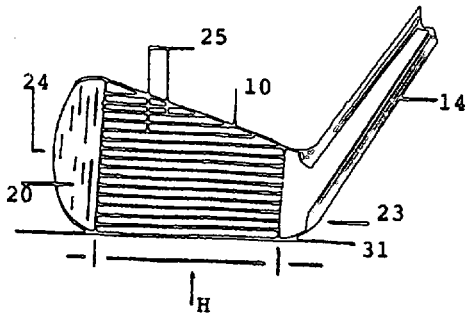
FIG.10 (Prior Art)
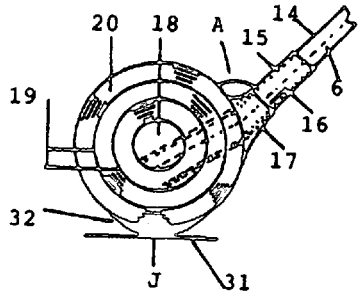
FIG.11

RADO'S CYLINDRICAL GOLF CLUB HEADS AND MULTIFACETED HAND GRIPS

CROSS-REFERENCE TO RELATED APPLICATION

Not Applicable

STATEMENT REGARDING FEDERALLY SPONSORED RESEARCH OR DEVELOPEMENT

Not Applicable

REFERENCE TO A MICROFICHE APPENDIX

Not Applicable

BACKGROUND OF THE INVENTION

An object of the present invention is about a completely new and improved Golf Club with a cylindrical Head, a circular Face with circular Grooves, a multifaceted Hand Grip for the shaft and a new and unique Neck, Hosel Tube Neck and Shaft 'placement' (location) for a full set of golf clubs, which traditionally comprises a number of wooden golf clubs, generally Nos. 1, 2, 3 and 4 and a number of iron golf clubs, generally Nos. 2 through 9, a pitching Wedge and a Putter, and any other golf clubs that may be required to play the game of golf. These golf club heads have a more concentrated, compact and larger face, which will enhance the golfer in executing greater control in stroking the golf ball. And then, the club shaft, with this New Hand Grip, will not twist in the golfer's hands.

Re-inventing the Golf Club Head. The greatest breakthrough in Golf Club Heads. Just think about a Golf Club Head that has less wind resistance, less ground contact or drag. Golf Club Heads that can whip through the rough, or a bad lie, with the greatest of ease. Skim off or dig into sand traps with very little effort. And a club shaft, with this new Hand Grip Design, that will not twist in the golfer's hands upon contact with the golf ball. These are just a few of the many improvements and advantages of the present invention. You see, these Golf Club Heads are Cylindrical in shape with Circular Faces and Convex Backs. And the club shaft featuring a Many Sided Hand Grip, instead of the rounded grip of the prior art.

An object of the present invention is about a new Golf Club Head 'design' that shows an important and unique development, in that, all the Golf Club Heads do not have any Heels and Toes. And, as a result, these golf club heads have less resistance and ground contact permitting them to cut through rough areas with greater ease to get to the golf ball and obtaining better golf shot results, (as compared with present day golf club heads with their useless 'heels and toes' at which 'points' golfers are forever trying not to hit the golf ball).

This new feature—no Heels and Toes—eliminates the problem and difficulty golfers have in making sure that golf club heads in use today are always resting flat on the ground on their soles when addressing the golf ball. With the present invention, all the golf club heads, with their Cylindrical shape, are always soled when put to rest on the ground.

DESCRIPTION OF THE PRIOR ART

Looking at the Iron golf club heads in use today, except putters, a very odd shaped design is observed as these iron golf club heads have large Toes and small Heels—that is, the distance from the top of the head to the sole. The top of the Head slants from the toe to the heel. There is no balance in these club heads, which makes it extremely difficult to strike the golf ball with the 'sweet spot' and, thus, executing desirable golf shots. Even the Wooden golf club heads in use today have similar problems as the distance from the Toe to the Heel is greater than the distance from the Sole to the top of the Head, which makes it quite difficult to get good square shots at the golf ball.

All Iron Golf Club Heads in use today, except Putters, cannot stand on their own when put to rest on their Soles on the ground with the golf club shaft just resting on the golfer's hand or fingers. These golf clubs will fall backwards if the Shafts are not held firmly. This is because of their narrow Soles and thin Bodies, which make them top heavy. So, imagine what happens when these golf club heads try to resist the sudden impact of the golf ball. And, so, it is readily seen and understood that when a golfer hits a golf ball with one of these Iron golf club heads of the prior art, then, said golfer has an added task of gripping the golf club's shaft firmer/harder at the point of impact with the golf ball, otherwise the golf club shaft will twist in the golfer's hands causing the golf ball to be struck awkwardly and veer off in a wrong trajectory. And with this extra squeezing of the fingers around the club shaft grip will surely alter the golf stroke.

Looking at the hand grips of the prior art, it is observed that they are rounded. And, as it is easy to conclude, one can see why the golf club shaft slips/twists in the hands of the golfer at impact with the golf ball. But with the use of this new Multifaceted Hand Grip design, golfers will not have to hold the club shaft tighter when hitting the golf ball.

Another big problem with present-day golf club heads is that a golfer has an added task or burden of raising the Heel or the Toe to sole the golf club head at all times when addressing the golf ball.

In addition to the previous problems, are the Horizontal lines on the faces of these golf club heads of the prior art. When any one of these golf club heads of the prior art—not the putters—hits a golf ball, the material of the golf ball yields and softens to the sudden impact of the golf club head. As it does so, the golf ball grabs on to these horizontal lines and rides them off to the left or to the right depending on the golfer's swing and the contact of the golf club head with the golf ball. And here is yet another problem. All golf club heads of the prior art have more golf club head contact with the ground. This is because of the Heel and Toe features and the positions where they are placed on the golf club head. With so much club head contact with the ground, more resistance is met, and so, more force is required to plow through the ground or rough areas to get to the golf ball to stroke it. And this extra 'zip' will surely put the golf ball off its course. There is no 'body' to these iron golf club heads of the prior art (just a flat/thin blade) to give the necessary resistance, force and power, at impact with the golf ball, that all golfers need when executing their golf shots. Golfers have to depend solely on brute strength to get the desired distance when striking the golf ball. That is a major flaw in the prior art.

Unless golfers have golf clubs made especially for them to suit their height and/or the length of their arms, the toe of the golf club heads of the prior art must be adjusted (up or down) so that the sole rests flat on the ground (a golf club head's definite requirement) whenever they (golfers) address the golf ball. Putters are the exception here. Because the soles of the golf club heads of the prior art are off the horizontal lie or not flat on the ground, golfers are constantly making bad golf shots with these golf clubs. Another reason why the golf ball goes off to the right or to the left when struck by the wooden golf club head of the prior art, is because of the fact that the faces of these wooden golf club heads have a slight curve. They are not as flat as the faces of the iron golf club heads.

Bigger and bigger golf club heads are being made, but this extra mass (material) is being placed in the wrong areas. You do not need more gimmicks, like larger wooden golf club heads or larger perimeters for the iron golf club heads. What is needed is more 'body' (as in the distance from the face to the back of the golf club head).

Here are a few things that hamper a good golf shot: (1) The shape of the golf club head. (2) The little hitting area on the face. (3) There is no 'body'/mass/substance to enhance the golf shot. And (4) The tendency of the round hand grip to twist when the golf ball is struck.

SUMMARY OF THE INVENTION

It is an object of the present invention to provide a new and improved Golf Club Head. A new concept in Golf Club Heads. The greatest breakthrough in golfing history. Reinventing the Golf Club Head as it is known today. The present invention is about a completely new golf club head. The present invention is about golf club heads that are Cylindrical in shape with Circular Faces that have Grooved Circles, approximately one-eighth (⅛) of an inch apart (see diagrams) with a Center Circle approximately three-quarters (¾) of an inch in diameter which is Red in color with the club's number/name/letter inscribed/stamped there-on. And the Backs of these golf club heads of the present invention are Convex in shape.

In addition to the club head that is cylindrical in shape, is a Hand Grip that will not slip/twist in your hands when hitting the golf ball. A Hand Grip which is Multifaceted, in that, it has six (6) flat surfaces/sides with the edges slightly rounded where the surfaces meet. These edges will fit into the grooves of the bent fingers as the hands encircle the shaft, thus giving a more secure hold onto the shaft. The shaft, surely then, will not twist in the golfer's hands as the rounded ones do when the golf ball is struck. This Grip is not round like that of the prior art. Each flat surface of this Grip is approximately five-eighths (⅝) of an inch at the top and tapers down to about three-eighths (⅜) of an inch at the end, with a flat surface facing up and in line with the golf club head as the club head rests on the ground in the position to hit the golf ball. This flat surface, in other words, will end up in the position where the thumbs of both hands will normally rest on the grip at the time of addressing and stroking the golf ball.

It will be seen in the construction that the diameter of the face of each iron golf club head of the more lofted clubs increases while the faces take on a somewhat oval shape through-out. Now, as will be seen with each wooden golf club head, since there is not a significant increase in the lofts, the change in the diameters is minimal. The diameters of the circular faces of these golf club heads to vary from two and one-quarter (2¼) inches to two and one-half (2½) inches approximately. The diameter starts at about two and one-half (2½) inches for the No. 1 wooden golf club head (Driver) and decreases down to about two and one-quarter (2¼) inches for the No. 4 wooden golf club head. Then the diameter starts at about two and one-quarter (2¼) inches for the No. 2 iron golf club head and increases up to about two and one-half (2½) inches for the sand/pitching wedge. The diameter of the putter to be about two and one-half (2½) inches.

Checking the drawings of the present invention, you will see that I have eliminated the Heels and the Toes and have combined the golf club head into a more expanded hitting area all around the circular face. With the elimination of the Heels and the Toes, there is less ground contact, and as a result, less drag and less wind resistance (major differences). This golf club head of the present invention (not the putter) will be able to cut through the 'rough' with greater ease and also plow through 'sand traps' (bunkers) with very little effort. The golfer, then, as a result of more golf club head (mass), will not have to use as much power in swinging this golf club. Another great feature of the present invention is that golfers will not have to worry about 'soling' the golf club head as they do with the golf club head of the prior art. And, also, golfers will not have to worry about keeping the iron golf club head of the present invention from falling backwards. The golf club head of the prior art (except the woods and the putter) when put to rest/stand on the ground, will fall backwards if this golf club shaft is not held firmly. The golf club head of the present invention will not have this problem, even if the golf club shaft just rests on the golfer's finger(s). This is because of the Cylindrical shape with its depth from the face to the back of the head, which gives the golf club head enough sole to rest on.

Another object of the present invention (with its Cylindrical shape) is, no matter how much this golf club head is raised or lowered, with this unique no Heel and Toe design, the center of the golf club face, acting as the 'hub' of a wheel, will always be the same distance to the ground. With the golf club head of the prior art, the center or 'sweet spot' is always affected whenever the toe or heel is raised as golfers make adjustments for their height or the length of their arms—a constant worry and inconvenience to golfers—unless golfers have golf clubs custom built for themselves.

And, still, another object of the present invention is a new and unique 'placement' of the Neck, the Hosel Tube Neck and the Shaft on the golf club head. This is done in such a way that if the center of the Shaft is extended into the golf club head, at the proper angle, it will pass through the intersection of a horizontal line and a vertical line if these lines were drawn at right angles through the approximate center of the golf club head (this is a very important and critical feature of the present invention). The shaft can be constructed so that it forms a one-piece extension around which the golf club head is built. More about this Neck, the Hosel Tube Neck and the Shaft 'placement' in greater detail later.

And, yet, another object of the present invention is the Multifaceted Hand Grip used instead of the rounded hand grip of that which is old. The golfer, then, as a result, would have no fear of the shaft twisting in his/her grip as the club head makes contact with the golf ball.

OBJECTS OF THE INVENTION

And, so, a main object of the present invention is to provide a completely new set of Golf Club Heads that are Cylindrical in shape with Circular faces that have Circular Grooves for better ball control and a straighter line of flight.

There is a Center Circle, approximately three-quarters (¾) of an inch in diameter which is Red in color with the golf club's name/number/letter inscribed or stamped there-on. The diameters of these Circular Faces vary from approximately two and one-quarter (2¼) inches to two and one-half (2½) inches.

And, yet, another object of the present invention is to provide a completely new set of Golf Club Heads with a wider hitting surface area that redistributes the impact when the golf club head strikes the golf ball, thus giving a more powerful and direct shot.

Still, it is yet another object of the present invention to provide a new set of Golf Club Heads with a unique Neck, Hosel tube neck and Shaft 'placement' there-on. The Center of the Shaft is positioned at the approximate center at right angles to the outside of the golf club head, which makes swinging the golf club and hitting the golf balls more enjoyable, leading to getting better results.

And, another object of the present invention, is the new Multifaceted Hand Grip that ensures straighter golf shots of the golf ball as the club shaft will not twist in the hands of the golfers. Also, the golfer will not have to put any extra squeeze on the golf club shaft.

It is still another object of the present invention to provide a completely new set of Golf Club Heads that have no Heels and Toes, thus ensuring a more concentrated hitting area.

And, it is still another object of the present invention to provide a completely New set of Golf Club Heads that will have less drag and less resistance and that will cut through the rough with the greatest of ease, because of the Cylindrical shape, thus enhancing the golfer's performance.

BRIEF DESCRIPTION OF THE DRAWINGS

The objects and advantages as previously described, and also, more objects and advantages as described again, will be explained and understood in the following descriptions, and also in the following drawings, in which:

FIG. 8 provides the top elevational view of the prior art.

FIG. 9 provides the top elevational view of the present invention.

FIG. 10 provides the front elevational view of the prior art.

FIG. 11 provides the front elevational view of the present invention.

FIGS. 10 and 11 provide the front elevational views as a comparison of the hitting areas of the prior art and the present invention.

DESCRIPTION OF THE PREFERRED EMBODIMENT

The various views of FIGS. 1–13 of the drawings illustrate the results of the many steps taken in constructing the Cylindrical Golf Club Head with the unique placement of the shaft according to a preferred embodiment of the present invention and as shown and as explained.

Figure 2:
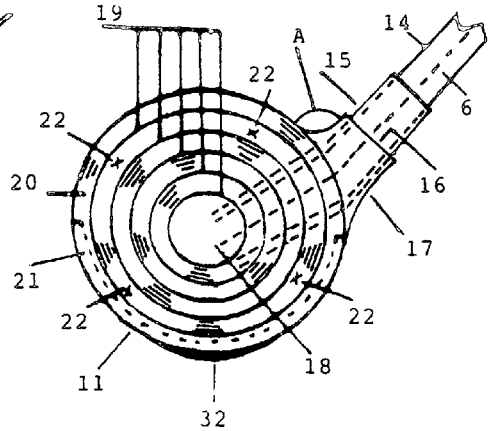
FIG. 2 is a front elevation of the Golf Club Head, both wooden and iron, partially cut away, in accordance with the present invention.
Figure 3:
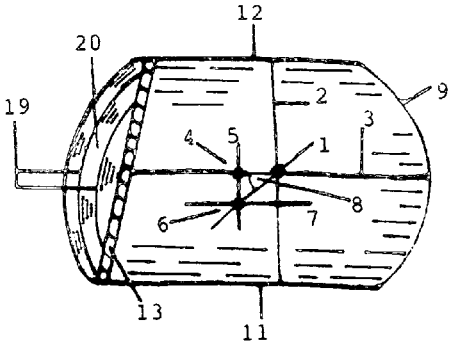
FIG. 3 is a cross-sectional view of a typical right-handed Cylindrical Golf Club Head of the present invention.
Figure 4:
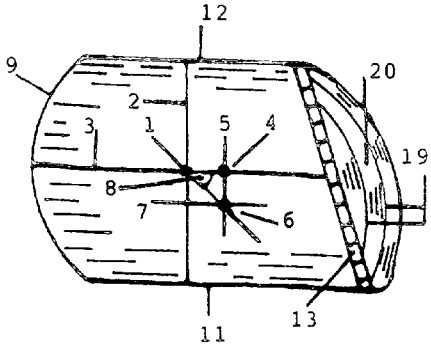
FIG. 4 is a cross-sectional view of a typical left-handed Cylindrical Golf Club Head of the present invention.
Figure 5:
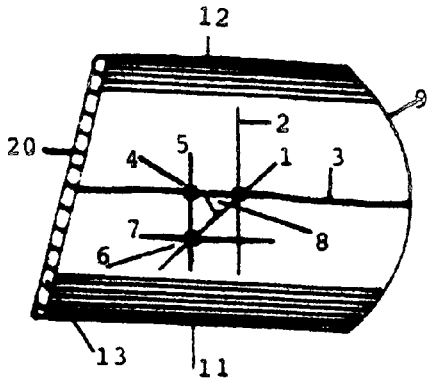
FIG. 5 is a side elevational view of a typical right-handed Cylindrical Golf Club Head of the present invention.
Figure 6:
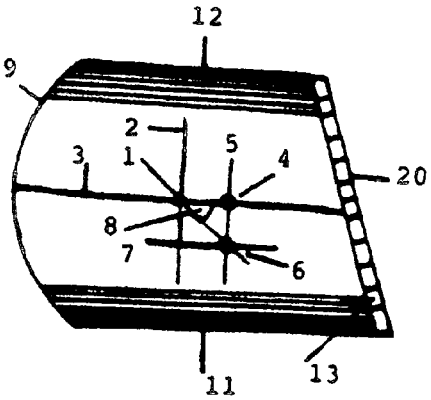
FIG. 6 is a side elevational view of a typical left-handed Cylindrical Golf Club Head of the present invention.

This procedure is for the Wooden Golf Club Head 10, but the construction of all the golf club heads of the present invention can be the same as is the practice in use today since my invention is not of a new way of constructing a golf club head but rather of a new golf club head design. After the loft is cut to the proper angle/degree, the Circular striking Face 20 is machined and prepared for the Face Plate 13, which is engraved with Circular Grooves 19 approximately six (6) in number. A hole/bore 16 is drilled through the center 6 of the tube neck 17 all the way to the center of the golf club head 10 to receive the hosel tube neck 15 as illustrated in FIG. 2, page 1. The bore 16 is drilled at a pre-determined lie angle and face angle in the golf club head 10 to match the various shaft angle A to the golf club head 10. The shaft 14 is then inserted into the hosel tube neck 15, which is inserted into the tube neck 17, and then the shaft 14 and the hosel tube neck 15 and the tube neck 17 are welded or glued together.

Now, this procedure is for the iron golf club head 10. The tube neck 17 and the iron club head 10 may be extruded, drawn or forged, but as one unit. The hosel tube neck 15, which can be of any color—black, etc., is fitted onto the shaft 14 and is then placed into the tube neck 17 then glued/welded there-after. The shafts 14 that have to be used with the present invention are to be of the conventional types, having the standard lengths and constructed of the same materials but, with the Hand Grips of the Multifaceted design.

Figure 7:
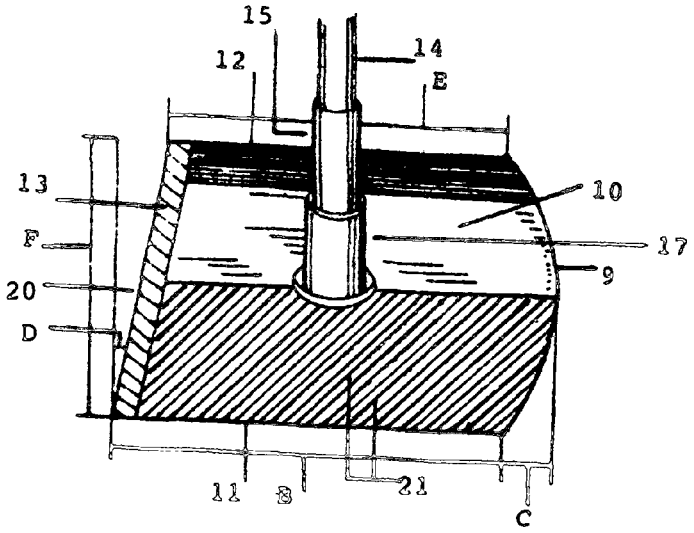
FIG. 7 provides the side elevation of the typical views of a full set of Cylindrical Golf Club heads of the present invention but, with each golf club head having its own standard lofts or face angles and other features and dimensions.

The various sizes/lengths of the Golf Club Head 10 as measured along the sole 11 from the bottom tip of the face 20 to the spot where the Convex Back 9 starts and as referenced by the letter B, the size/length of the convex back 9 as measured from the spot where the convex back 9 starts to the spot where it ends, and as referenced by the letter C, the size/length of the top 12 of the head 10 as measured from the face 20 to the spot where the convex back 9 starts and as referenced by the letter E, the height of the club head 10 as measured from the sole 11 to the top 12 of the head 10 and as referenced by the letter F are explained here-to-fore:

FIG. 7 represents the typical side elevational views of a full set of golf club heads of the present invention since the general make up is identical but, with these exceptions:—each golf club head taking on its own loft or face angle and, also, only the Woods having a metal sole plate 21 and a plastic or bony face plate 13.

Figure 1:
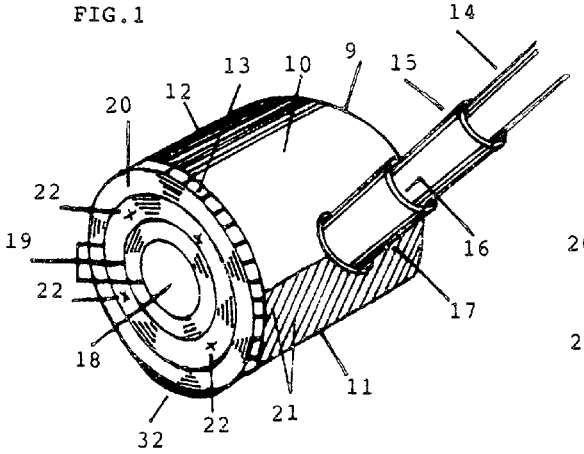
FIG. 1 is a perspective view of the finished Golf Club Head of the present invention that represents the golf club heads which are Cylindrical in shape, with Circular Faces and with no Heels and Toes and that also shows the unique positioning of the shaft.

Now, referencing FIG. 7, in conjunction with FIG. 1, as seen and as explained, the various loft angles D of all the faces 20, and other features, of a full set of golf club heads 10 of the present invention are listed as follows:

The No. 1 wooden golf club head 10 will have a Circular Grooved Face Plate 13 with a diameter two and one-half (2½) inches, having a sole plate 21 that also fits around the convex back 9, the height F being two and three-sixteenths (2³⁄₁₆) inches, the length E being two and nine-sixteenths (2⁹⁄₁₆) inches, the loft angle D being eleven (11) degrees, the length B being three (3) inches and the length C being one-half (½) of an inch. The No. 2 wooden golf club head 10 also has similar features with a circular grooved face plate 13 with a diameter two and three-eighths (2⅜) inches, but with the height F being two and three-sixteenths (2³⁄₁₆) inches, the length E being two and one-eighth (2⅛) inches, the loft angle D as being thirteen (13) degrees, the length B being two and five-eighths (2⅝) inches and the length C being one-half (½) of an inch. The No. 3 wooden golf club head 10 has similar features but with the height F being two and three-sixteenths (2³⁄₁₆) inches, the length E being one and three-quarter (1¾) inches, the loft angle D as sixteen (16) degrees, with the circular grooved face plate 13 with a diameter two and one-quarter (2¼) inches, the length B being two and one-half (2½) inches and the length C being one-half (½) of an inch. The No. 4 wooden golf club head 10 also has the same features as the previous wooden golf club heads, the circular grooved face plate 13 to be two and one-quarter (2¼) inches in diameter, the length B being two and three-eighths (2⅜) inches and the length C being one-half (½) of an inch but showing the loft angle D as nineteen (19) degrees, the length E being one and five-eighths (1⅝) inches and the height F being two and one-eighth (2⅛) inches.

All the measurements stated thus far, and those that follow, are to be 'plus or minus'.

And, now, the iron golf club heads 10. The putter will have its circular grooved face 20 with a diameter of two and one-half (2½) inches, its convex back 9, the top 12 of its head 10, its sole 11, the height F being two and one-half (2½) inches, the length E being one and one-half (1½) inches, the loft angle D is three (3) degrees, the length B being one and five-eighths (1⅝) inches and the length C being one-half (½) of an inch. The No. 2 iron golf club head 10 will also have a circular grooved face 20 with two and one-quarter (2¼) inches in diameter, the convex back 9, the top 12 of its head 10, the sole 11, the height F being two and one-half (2½) inches, the length E being one-half (½) of an inch, the loft angle D to be twenty (20) degrees, the length B to be one and three-eighths (1⅜) inches and the length C to be one-half (½) of an inch. The No. 3 iron golf club head 10 will have similar features as the circular grooved face 20 with two and one-quarter (2¼) inches in diameter, the sole 11, the top 12 of its head 10, the convex back 9, the height F being two and one-sixteenth (2¹⁄₁₆) inches, the length E being one-half (½) of an inch, the loft angle D being twenty-four (24) degrees, the length B being one and one-half (1½) inches and the length C being one-half (½) of an inch. And, now, the No. 4 iron golf club head 10 will have a circular grooved face 20 with a diameter of two and one-quarter (2¼) inches, the top 12 of its head 10, the convex back 9, the sole 11, the height F being two (2) inches, the length E being one-half (½) of an inch, the loft angle D being twenty-eight (28) degrees, the length B being one and five-eighths (1⅝) inches and the length C being one-half (½) of an inch. The No. 5 iron golf club head 10 will have similar features as the circular grooved face 20 with a diameter of two and three-eighths (2⅜) inches, the convex back 9, the sole 11, the top 12 of the head 10, the height F being one and fifteen-sixteenths (1¹⁵⁄₁₆) inches, the length E being one-half (½) of an inch, its loft angle D to be thirty-two (32) degrees, the length B being one and three-quarters (1¾) inches and the length C being one-half (½) of an inch. And now the No. 6 iron golf club head 10 with its circular grooved face 20 with a diameter of two and three-eighths (2⅜) inches, its convex back 9, its sole 11, the top 12 of its head 10, the height F being one and thirteen-sixteenths (1¹³⁄₁₆) inches, the length E being one-half (½) of an inch, its loft angle D of thirty-six (36) degrees, the length B being one and seven-eighths (1⅞) inches and the length C being one-half (½) of an inch. The No. 7 iron golf club head 10 is next with its circular grooved face 20 with a diameter of two and three-eighths (2⅜) inches, the convex back 9, the sole 11, the top 12 of its head 10, the height F being one and three-quarter (1¾) inches, the length E being one-half (½) of an inch, the loft angle D to be forty (40) degrees, the length B to be two (2) inches and the length C being one-half (½) of an inch. The No. 8 iron golf club head 10 also has a circular grooved face 20 with a diameter of two and three-eighths (2⅜) inches with its convex back 9, the top 12 of its head 10, the sole 11, the height F being one and five-eighths (1⅝) inches, the length E being one-half (½) of an inch, the loft angle D is forty-four (44) degrees, the length B to be two and one-eighth (2⅛) inches and the length C being one half (½) of an inch. The No. 9 iron golf club head 10 will also have a circular grooved face 20 with a diameter of two and one-half (2½) inches, the convex back 9, the top 12 of its head 10, the sole 11, the height F being one and five-eighths (1⅝) inches, the length E being one-half (½) of an inch, the loft angle D to be forty-nine (49) degrees, the length B to be two and three-eighths (2⅜) inches and the length C one-half (½) of an inch.

Now, the pitching wedge will also show its circular grooved face 20 with a diameter of two and five-eighths (2⅝) inches, its convex back 9, its sole 11, the top 12 of its head 10, the height F being one and one-half (½) inches, the length E being one-half (½) of an inch, its loft angle D to be fifty-five (55) degrees, the length B being two and five-eighths (2⅝) inches and the length C being one-half (½) of an inch.

Figure 12:
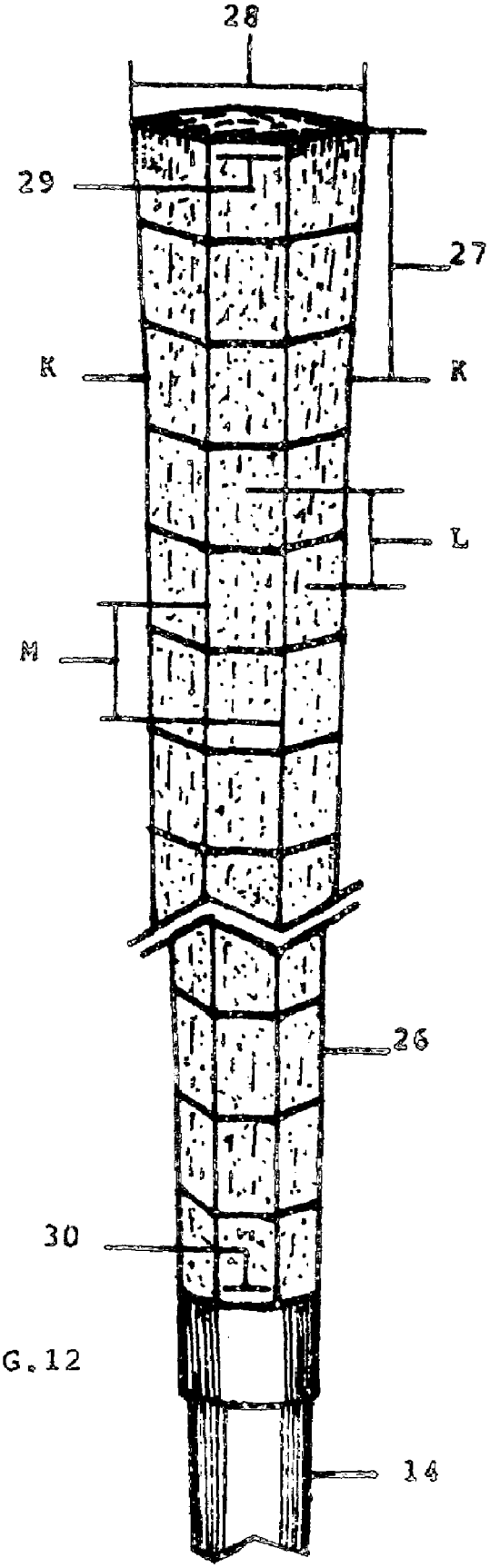
FIG. 12 provides a perspective view and general make up of the Multifaceted Hand Grip of the present invention.

The new Multifaceted Hand Grip design is shown, not wrapped or taped, in FIG. 12, and is made to fit on all club shafts that are in use today, and as such, the shafts will be of the same construction, have the same bore and the same length as the prior art. This new Hand Grip is made with six (6) flat sides with each side having the same dimensions approximately five-eighths (⅝) of an inch at point 29 and tapered down to approximately three-eighths (⅜) of an inch at point 30. As can be seen in FIG. 12, this hand grip 26 fits onto the shaft 14. The length of the hand grip 26 to be approximately ten and five-eighths (10⅝) inches, the head 27 to be approximately one and one-quarter (1¼) inches. The top/Butt 28 of the head 27 to be approximately one and three-sixteenths (1³⁄₁₆) inches across and tapered down to approximately one (1) inch at points K.

It is to be understood, here and now, that the 'Shaft' is, in no way, a part of the present invention, as the present invention pertains only to the 'design' and make-up of the Golf Club Head, the 'placement' of the neck, the hosel tube neck and the shaft there-on and the multifaceted hand grip, which is used on the shaft of the prior art, and that any and all shafts of the traditional and conventional types can and will be used in the present invention.

The list that follows on page 9 of these specifications, shows an approximation of some of the various measurements and weights of the finished golf club of the present invention and provides the dimension parameters for the preferred embodiment of a set of golf clubs of the present invention.

Various Golf Club

Measurements and Weights

| GOLF CLUBS | Club Shaft Length (In Inches) | Shaft to Club Head Angle (In Degrees) | Golf Club Weight (In Ozs.) |
|---|---|---|---|
| Woods No. 1 | 44 | 125 | 12 |
| 2 | 43 | 130 | 12.5 |
| 3 | 42 | 125 | 12.5 |
| 4 | 41 | 129 | 13 |
| Irons 2 | 39 | 105 | 14 |
| 3 | 38 | 100 | 15 |
| 4 | 38 | 105 | 15 |
| 5 | 37 | 100 | 15 |
| 6 | 37 | 100 | 15 |
| 7 | 36 | 110 | 16 |
| 8 | 36 | 100 | 16 |
| 9 | 35 | 100 | 16 |
| Pitching Wedge | 34 | 100 | 16 |
| Putter | 35 | 110 | 13 |

Referring now to the accompanying drawings in greater detail, the present invention illustrates a new Golf Club Head 10 that is Cylindrical in shape with a Circular Face 20, and that has a Convex Back 9. The wooden golf club head 10 having a White Circular Grooved Face Plate 13 approximately three-sixteenths (3/16) of an inch thick and a Brass/Steel Sole Plate 21 approximately one-eighth (1/8) of an inch thick, but with the very bottom 32 of the sole plate, from the front tip to where the convex back starts, made thicker by approximately one-eighth (1/8) of an inch and approximately one (1) inch wide. For example, as explained here, find the very center of the sole plate, and by looking at the face of the golf club head measure one-half (1/2) of an inch to the left and one-half (1/2) of an inch to the right of this center mark and let this be the area that is made thicker by the eighth (1/8) of an inch and which must blend in with the circumference at the bottom of the cylindrical golf club head. Part of the present invention is a Multifaceted Hand Grip for the club shaft. The Circular face 20 is from two and one-quarter (2 1/4) inches to two and one-half (2 1/2) inches in diameter with the No. 1 wooden golf club head 10 (the driver) being about two and three-eighths (2 3/8) inches and reducing gradually to about two and one-quarter (2 1/4) inches for the No. 4 wooden golf club head 10. Now the diameter of the iron golf club head 10 starting from about two and one-quarter (2 1/4) inches for the No. 2 iron and increasing up to about two and one-half (2 1/2) inches for the pitching wedge. The putter having a diameter of about two and one-half (2 1/2) inches. The circular face 20 of all the iron golf club heads 10 also have grooved circles 19 one-eighth (1/8) of an inch apart with a center circle 18 three-quarters (3/4) of an inch in diameter which is red in color with the golf club's name/number/letter inscribed or stamped there-on. All the golf club heads of the present invention have a Convex back 9 and a unique Neck 17, Hosel Tube Neck 15 and Shaft 14 'placement' that if the Center of the Shaft 14 were to be extended at the proper angle, it will pass through the approximate center of the golf club head.

In this new cylindrical golf club head design, I have eliminated the 'heel' 23 and the 'toe' 24 areas, FIGS. 8 & 10, of the prior art, but I have incorporated them into one concentrated hitting area that forms the circular face 20 of the golf club head 10 of the present invention, FIGS. 9 & 11. This combining of the heel 23 and the toe 24 areas will allow for more of a hitting surface area and less ground contact, drag and resistance.

A great advantage of the golf club head 10 of the present invention, with its cylindrical shape, is when it is put to rest on the ground, it will not fall backwards but will rest flat on its sole without any help from the golfer, but solely with the club shaft just resting in the golfer's open hand. But the iron golf club head 10 of the prior art, except the putter, when put to rest on the ground on its sole 11, will fall backwards immediately if this golf club shaft is not held firmly by the golfer. Also, a firmer grip is required when a golfer hits a golf ball with any one of these golf clubs of the prior art. But with the Multifaceted hand grip design, the golf club shaft will not shift/twist in the golfer's hand.

Looking at Drawing No. 8, Page No. 3, viewing from the top at point G, the design of the prior art can be seen to be a big drawback to good golfing as the thickness (that is, the distance from the face to the back) of the iron golf club head 10 is not sufficient to give the proper support and resistance to the sudden impact with the golf ball. This calls for more force by the golfer in hitting the golf ball, which causes the golf club shaft to twist in the golfer's hands, but which is corrected by the use of the multifaceted hand grip. The distance from the face to the back of the golf club head of the present invention, as illustrated by the accompanying drawing No. 9, Page No. 3, at point B, is, here and now, designed to give sufficient resistance and support to eliminate all golfers' fears, and also, to make golfing more enjoyable and rewarding.

As can be seen by Drawing No. 10, Page No. 3, the design of the prior art shows at point H (the sole of the golf club head) that there is more material that touches the ground 31. As there is more ground contact, more force is required by the golfer when hitting the golf ball, especially from the rough, sand trap, etc. Now, looking at Drawing No. 11, Page No. 3, of the present invention, you will see at point J, there is very little ground 31 contact, due to the no 'heel' and 'toe' design, and its cylindrical shape, resulting in less force by golfers when hitting the golf ball.

Referring to Drawing Nos. 10 and 11, Page No. 3, Drawing No. 10 shows horizontal grooves 25 as they appear on the face 20 of the golf club head 10 of the prior art, and Drawing No. 11 shows circular grooves 19 as they appear on the circular face 20 of the golf club head 10 of the present invention. But there is a big difference between both designs.

When a golf ball is struck with the golf club head 10 of the prior art (except the putter) the golf ball yields and softens to the sudden impact. As it does so, the golf ball grabs on to these horizontal lines 25 and rides them off to the left or to the right, depending on the point of contact of the golf club face 20 with the golf ball and the golfer's swing. Look at the great golfers and see how upset they get whenever they make a bad golf shot.

By the same token, when the golf club face 20 of the present invention strikes a golf ball and the golf ball tends to go off target, depending on how the golf club face 20 strikes the golf ball, then the circular grooves 19 on the circular face 20 of the golf club head 10 grab on to the golf ball, hold it in check and pull it back into a straighter trajectory.

Another great advantage of the cylindrical shape of the present invention over the prior art is the elimination of the heel 23 and the toe 24. With this new design, the golf club head 10 will always be 'soled', even if golfers make adjustments for their heights or the lengths of their arms as they address the golf ball. But when golfers address the golf ball with the golf club head 10 of the prior art, the toe 24 or the heel 23 of this golf club head 10 is always raised or lowered as golfers make adjustments for their heights or the lengths of their arms thus causing said golf club head 10 not to be soled. And this movement of the golf club head 10 changes the distance from the ground to the 'sweet' spot of the golf club head 10 making it very difficult to execute good golf shots.

And yet another advantage of the present invention over the prior art, is the unique 'placement' of the neck 17, the hosel tube neck 15 and the shaft 14. Reference is made to the 'Arm' and the 'Hand' as a comparison to the golf club shalt 14 and the golf club head 10, with the neck 17 and the hosel tube neck 15 being the connecting point between the two. Now, if a center line is drawn down the 'arm', this line will pass through the center of the 'hand'. Thus the reason for a perfect stroke when the center of the hand hits an object. The greatest force at impact comes from the center of the hand. If you combine the hitting area with the spot of greatest resistance (the center of the golf club face) then you will get the maximum effect of the best shot.

If you want to break down a real heavy door that is stuck shut, you would not take a piece of board and hit the door with the flat side in order to open the door. The best, and only, thing to do, is to take a 'log' and hit the door with one end of this 'log' (used as a battering ram) and that door is sure to open.

It is, therefore, understandable, that if you take your open hand and slap an object, and then, you put your hand into a 'fist' and hit that same object, which situation will result in a greater/harder impact.

And, so it is, with this new and unique neck 17, hosel tube neck 15 and shaft 14 placement on the golf club head 10 of the present invention. The extension of the golf club shaft 14, at the proper angle, fits into the spot that forms the approximate center 6 of the golf club head 10. It is like having a small block of wood, approximately three-quarters (¾) of an inch around that forms the extension of the shaft 14, around which the golf club head 10 is molded and shaped to all the different club head sizes, lofts and measurements.

This neck 17, hosel tube neck 15 and shaft 14 placement is a very critical part of the design. And, as such, is anchored at the approximate center at point 6 at right angles on the 'outside' circumference of the golf club head 10 of the present invention so that the exact center of the shaft 14, if it were extended into the golf club head 10, at the proper angle, it would meet the spot where a vertical line 2 and a horizontal line 3—if drawn—intersect at right angles as explained below. But, first, the center spot 6 of the golf club head 10 where this vertical line 2 and this horizontal line 3 are drawn from must first be ascertained.

And, so, this approximate 'center spot' 6, see FIGS. 3–6, on each golf club head 10 of the present invention, where the neck 17, the hosel tube neck 15 and the shaft 14 are fitted, is found where a horizontal axis, passing through the center 1, drawn on the outside of the golf club head 10, from the face 20 to the convex back 9, intersects with a vertical axis, at right angles, as drawn from the center of the top 12 of the golf club head 10, on the outside, to the center of the sole 11, as measured from the bottom tip of the face 20 to the apex of the convex back 9.

And, now, the spot where the neck 17, the hosel tube neck 15 and the center of the shaft 14 are positioned on the side of the golf club head 10, is explained (and as shown in Drawing No. 5, which is a side elevational view of the golf club head 10, Page No. 2) as follows: find the center of the top 12 and also the center of the sole 11 of the golf club head, measure the distance between these two center points around the circumference, find the half mark of this measurement and draw a horizontal line 3, from the face 20 to where the convex back 9 starts, through this point 1. Now, taking a thin piece of wood approximately one-quarter (¼) of an inch thick—put it to rest on a flat surface on one edge and then balance the club head on the top of the other edge so that the club head does not fall forward or backward. (It should be noted here that we are working only with the Golf Club Head and not with the Golf Club Shaft attached to the Golf Club Head). Now, mark the spot under the sole 11 where it balances on this strip of wood then draw a vertical line 2 through this spot all around the circumference to bisect the previous horizontal line 3 at right angles at point 1 on both right hand golf club heads and left hand golf club heads. From the center spot 1 where the vertical line 2 and the horizontal line 3 intersect, measure approximately one-quarter (¼) of an inch to the left at 4 on the right handed golf club head 10. Through this point 4 drop a vertical line 5 and measure approximately one-quarter (¼) of an inch directly below at 6. Draw a horizontal line 7 through 6 parallel to 3. This spot 6 is where the very center of the shaft 14 will be anchored, passing through the hosel tube neck 15, into the bore 16 and into the neck 17. The angle 8 formed by points 1 and 4 and points 1 and 6 is approximately forty-five (45) degrees.

Now, switch the picture around for the left handed golf club heads 10 (referring to Drawing No. 6, Page No. 2, which is a side elevation view of the golf club head 10. From the center spot 1, as found and as described earlier, where the vertical line 2 and the horizontal line 3 intersect, measure approximately one-quarter (¼) of an inch to the right at 4. From this point 4 drop a vertical line 5 and measure approximately one-quarter (¼) of an inch directly below at 6. This spot 6 is where the very center of the shaft 14 will be anchored, passing through the hosel tube neck 15, into the bore 16 and into the neck 17. The angle 8 formed by points 1 and 4 and points 1 and 6 is approximately forty-five (45) degrees.

This situate of the neck 17, the hosel tube neck 15 and the shaft 14 is very critical and important to the present invention as it allows for the maximum Pushing force, while at the same time, giving the optimum Pulling action, thus striking the golf ball with the greatest effect with this double driving action. This neck 17 and hosel tube neck 15 'positioning' also gives a more balanced weight with the golf club head 10 and shaft 14.

The neck 17, of the wooden club head 10, is extended and tapered at the top into which a bore 16 is drilled through point 6 at a pre-determined 'lie angle' and 'face angle' to receive the hosel tube neck 15 into which the shaft 14 is inserted, and then they are all welded/glued together. The bore 16 can be extended deep into the wooden golf club head 10 as illustrated in FIG. 2 Page 1. The hosel tube neck 15 is built to accommodate the shaft 14 as a support around the neck 17 and is built up in such a way that it would be neat and be of good appearance (just as the practice that is done today). The hosel tube neck 15 can be considered to be an extension and one with the golf club head 10.

The neck 17 and the hosel tube neck 15 of the iron golf club head 10 of the present invention may be extruded, drawn or forged, into which the shaft 14 is inserted and then glued/welded. However, it must be encouraged here that the traditional procedure used in the general and final make up and orientation of the neck 17, the hosel tube neck 15 and the shaft 14 and the final 'whipping' around these parts, can and must take precedence, since what is claimed here as the present invention is a 'cylindrical' golf club head 10 with no heel 23 and toe 24, with its 'circular' face 20 that has circular grooves 19, a 'convex back' 9, and the 'placement' of these traditional parts on the golf club head 10, and a multifaceted hand grip for the shaft.

There is a double forward action in the cylindrical golf club head 10 of the present invention. The face 20 pulls the convex back 9 forward while at the very same instant the convex back 9 pushes the face 20 forward. This action or result is caused by the unique orientation of the neck 17. The sudden impact that results, when the golf ball is struck, creates a chain reaction within the molecular structure of the golf club head 10 creating a ricocheting effect, thus causing this double forward action.

With the present invention, this hitting area starts at the very center 18 of the circular face 20 and spreads out like a rippling effect, thus allowing for a greater and wider hitting area, more control and straighter golf shots as compared to the prior art. Drawing Nos. 10 and 11, Page No. 3, show the comparisons between the horizontal grooves 25 and the circular grooves 19.

All golf club heads 10 of the present invention could be solid in construction, with no 'hollow cavity' in them. It is well known that a solid object can deliver more power than if that same object were hollow on the inside. The Driver and the Fairway Woods are made from any durable wood (and any combination thereof) that can withstand the vigorous and constant hitting of the golf ball. These wooden golf club heads 10 can also be constructed as 'metal' woods, using 'Titanium' (or the like), and because of its lightness, will allow for oversized heads beyond the two and three-eighths (2⅜) inches diameter. Or the construction of the wooden golf club head 10 of the present invention and the material used can be the same as is the practice that is used today.

Figure 13:
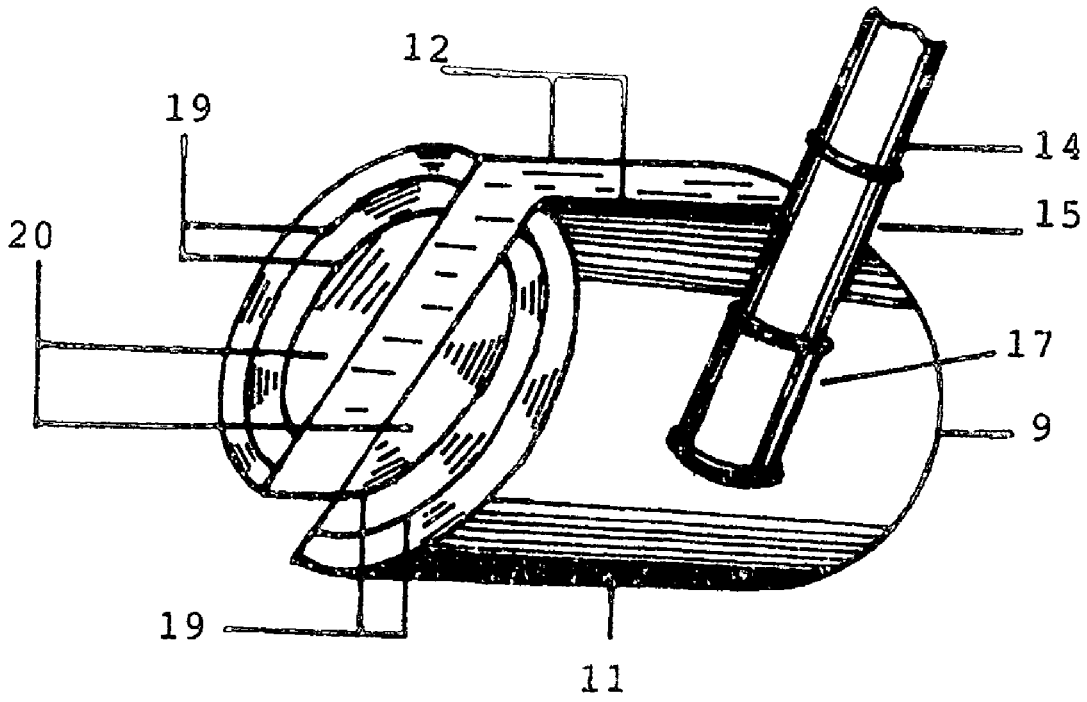
FIG. 13 provides a perspective view of the wooden golf club head as can be made from two half-round material.

Also, all the wooden golf club heads 10 of the present invention can be laminated and shaped to specifications, or they can be made from stock material, or they can be made from wooden rods of the specific diameter sizes. Also, they can be made from half round wooden material of the specific diameter sizes and then joined on the flat sides, by gluing, after the various lofts/face angles have been measured and cut off. FIG. 13, Page 5, illustrates this concept in which the cylindrical golf club head 10 is shown in two halves with the convex back 9, the sole 11, the top 12 of the head 10 the circular face 20 and the convex back 9 identified, as being some of its features.

And, now, on the other hand, the iron golf club heads 10 of the present invention can be made from various Iron Ore materials. They can be cast/forged to the club head sizes with their loft/face angles D, or they can be made from a single Billet of high strength material, or they can be made from stock Bars or Metal Tubing of the specific diameter sizes, cut to the various golf club head sizes, and their loft/face angles cut/machined accordingly. Also, all Clubs-Irons and 'Metal' Woods-can be made from Metal Tubing, which can then be filled with a substance to control the weight. Or the construction of these iron golf club heads 10 of the present invention and the material used can be the same as is the practice that is used today. Also, all Clubs—Irons and 'Metal' Woods—can be made from Metal Tubing which can then be filled with a substance for weight control.

'Titanium' can be used, or mixed with other alloys of compatible materials in the construction of these iron golf club heads in order to adhere to the required head weights. The wooden and iron golf club head weights, of the present invention, can be adjusted by lengthening or shortening the distance between the circular face and the convex back to meet the necessary requirements. The diameter of the more lofted iron golf club heads of the present invention can be increased up to two and one-half (2½) inches, plus or minus, starting with the number nine (9) iron and up.

The circular face 20, of the wooden golf club head 10 of the present invention, is covered with a white face plate 13 of the same diameter and is approximately three-sixteenths (3/16) of an inch thick, has circular grooves 19, has a red center circle 18 approximately three-quarters (¾) of an inch in diameter and made of a durable plastic or bony material with the golf club's name or number or letter inscribed/stamped there-on. The overall color of the club head 10 to vary from various stains to ebony, etc., or as desired by a golfer's preference.

The three-sixteenths (3/16) of an inch white circular face plate 13 has the same overall dimensions as the finished wooden golf club head 10. This three-sixteenths (3/16) of an inch face plate 13 would have circular grooves 19 that are approximately one-eighth (⅛) of an inch apart, and approximately one-sixteenth (1/16) of an inch deep and wide. This face plate 13 is glued and screwed with approximately four (4) brass screws 22 onto the circular face 20 of the wooden golf club head 10 of the present invention.

The iron golf club heads 10 of the present invention shall be of similar design/appearance as that of the wooden golf club heads 10, but without the face plate 13 and the sole plate 21, and they shall be all Chrome Plated, but with some putters having a black matte finish, or as desired by each golfer's own preference, the face will have circular grooves 19, a red center circle 18 approximately three-quarters (¾) of an inch in diameter with the golf club's name/number/letter stamped/inscribed there-on.

A one-eighth (⅛) of an inch thick, plus or minus, brass or steel plate 21 is fitted into a recessed area under the sole 11 of the wooden golf club head 10 of the present invention. The sole plate 21 is made to fit up to the horizontal half line 3 on both sides of the club head 10. This sole plate 21 can be constructed as one piece to also fit around the convex back 9 up to the half mark 3 and screwed into place. The sole plate 21 is made to fit under the face plate 13 so that the front end, or tip, of the sole plate 21 is flush with the bottom of the face plate 13. In other words, the bottom of the face plate 13 would be resting on the front tip of the sole plate 21. This sole plate 21 will serve as a dual purpose: (1) it makes for a good brace, giving support and strength, and (2) as a protection for the sole of the wooden golf club head 10.

The ridges M, formed by the surfaces L of the new Multifaceted Hand Grip 26, Page 4, are slightly rounded, and then this new hand grip 26 is taped around with an appropriate tape—or as is done with the hand grips that are in use today—to give a good appearance and a comfortable feel to the golfer.

The name 'RADO' is to be inscribed/stamped on the convex back 9 of the golf club head and which can be read left to right as when holding the golf club in an upright position. The name 'RADO' is to be stamped on the multifaceted hand grip 26 on the flat surface L that faces up when the golf club is at the address position and which can be read in a vertical manner with the 'R' starting at the top and with the 'O' ending at the bottom as when holding the golf club upright so that the golf club is vertical with the club head 10 towards the ground and with the Butt 28 toward the top. The name "Rado" may also be inscribed/stamped on the sole 11 of the golf head 10. The name "Rado" can be stamped on the very top of the Butt 28 of the shaft grip 26.

Other numbers and/or codes and Patented information will be stamped in various locations on the club heads 10 to be determined at time of manufacture and thereafter.

I claim:

1. A set of golf clubs comprising:

at least a plurality of clubs designated as "woods" and a plurality of clubs designated as "irons";

each of said clubs including a club head having a length extending from a front of the head to a back of the head, with the heads being cylindrical in cross section substantially along the entire length of the club head from said front to said back; each said club head further including a top portion when viewed from above and a sole portion;

said length being generally larger in dimension than the diameter of the cross section of the head for said "woods";

a rearmost portion of the back of each said club head further including a convex portion, when viewed from a side of the club head;

said front of each said club head being provided with a circular face;

said "woods" having a white circular face plate provided on said circular face, said face plate having a plurality of circular grooves, with said face plate having a diameter ranging from approximately 2¼ inches to 2½ inches;

said "irons" being void of a white circular face plate and having a plurality of grooves provided directly on said circular face;

each said head further including a neck, a hosel tube extending from said neck, and a shaft fitted with said hosel tube, said neck being provided on a side of said club head, when viewed from the front.

2. A set of golf clubs as recited in claim 1, and further including:

each said shaft being attached to said hosel tube such that the shaft passes through an intersecting point made by two lines oriented at right angles to each other;

one of said two lines being either a first vertical line that passes through a point that is approximately ¼ inch to the right of a weighted center line that extends along the longitudinal axis of the head in the case of a right-handed club, or a second vertical line that passes through a point that is approximately ¼ inch to the left of a weighted center line that extends along the longitudinal axis of the head in the case of a left-handed club;

the other of said two lines being either a horizontal line that passes through a point that is located on said first vertical line and is approximately ¼ inch below the weighted center line in the case of a right-handed club, or a horizontal line that passes through a point that is located on said second vertical line and is approximately ¼ inch below the weighted center line in the case of a right-handed club.

3. A set of golf clubs as recited in claim 1, and further including;

each said sole portion of said "woods" including a sole plate that extends upwards along the curved exterior sides and back of the club head to a plane that essentially divides the club head in half in a top-to-bottom orientation; said sole plate having a greater thickness at a central portion thereof along said sole portion;

each said sole portion of said "irons" being void of a sole plate.

4. A set of golf clubs as recited in claim 1, and further including;

each said club head including a bore that is drilled into the neck; said bore passing through the approximate geometric center of the golf club head.

5. A set of golf clubs as recited in claim 1, and further including;

said plurality of grooves having a 'V' shaped or 'square' shaped cross section approximately 1/16 inch wide and approximately 1/16 inch deep; said grooves being approximately ⅛ inch apart along the diameter of the circular face in the "irons" and approximately ⅛ inch apart along the diameter of the white circular face plate of the "woods".

6. A set of golf clubs as recited in claim 1, and further including;

each said circular face of said "irons" and each said white circular face plate of said "woods" having a centrally located circle that is red in color and is approximately ¾ inch in diameter, approximately 1/16 inch wide and approximately 1/16 inch deep; said red circle further including identifying indicia.

7. A set of golf clubs as recited in claim 1, and further including;

each said shaft including a hand grip attached thereto; said grip having a plurality of intersecting exterior faces that help to reduce twisting of the grip within a golfer's hands.

* * * * *